US009114507B2

(12) United States Patent
Wang

(10) Patent No.: US 9,114,507 B2
(45) Date of Patent: Aug. 25, 2015

(54) HOLDING APPARATUS

(71) Applicant: Hua-Yong Wang, Shenzhen (CN)

(72) Inventor: Hua-Yong Wang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 272 days.

(21) Appl. No.: 13/707,664

(22) Filed: Dec. 7, 2012

(65) Prior Publication Data

US 2013/0249153 A1 Sep. 26, 2013

(30) Foreign Application Priority Data

Mar. 23, 2012 (CN) ..... 2012 1 0078867

(51) Int. Cl.

| | |
|---|---|
| ***B25B 1/00*** | (2006.01) |
| ***B25B 9/00*** | (2006.01) |
| ***B25B 5/04*** | (2006.01) |
| ***B25B 5/14*** | (2006.01) |

(52) U.S. Cl.
CPC ... *B25B 9/00* (2013.01); *B25B 5/04* (2013.01); *B25B 5/14* (2013.01)

(58) Field of Classification Search
USPC ..... 269/3; 29/244, 254, 255, 278; 254/134, 254/133 R, 93 R, 89 H, 100, 103, 102
See application file for complete search history.

(56) References Cited

U.S. PATENT DOCUMENTS

| | | | | | |
|---|---|---|---|---|---|
| 4,648,166 | A * | 3/1987 | Tilman | 29/252 |
| 5,159,743 | A * | 11/1992 | Somerville | 29/252 |
| 5,787,561 | A * | 8/1998 | Harmand | 29/255 |
| 5,887,328 | A * | 3/1999 | Rydin et al. | 29/259 |
| 6,114,862 | A * | 9/2000 | Tartagni et al. | 324/662 |
| 6,283,475 | B1 * | 9/2001 | Stubben | 273/448 |
| 2003/0135992 | A1 * | 7/2003 | Ma | 29/762 |
| 2010/0132239 | A1 * | 6/2010 | Moody et al. | 42/72 |

* cited by examiner

*Primary Examiner* — Lee D Wilson
*Assistant Examiner* — Nirvana Deonauth
(74) *Attorney, Agent, or Firm* — Novak Druce Connolly Bove + Quigg LLP

(57) ABSTRACT

A holding apparatus for holding an object, includes a support mechanism, a driven mechanism slidably coupled to the support mechanism and slidable between a first position and a second position, a driving mechanism slidably coupled to the support mechanism and adapted to drive the driven mechanism to slide between the first position and the second position, and a clamping mechanism rotatably secured to the driven mechanism and the support mechanism. When the driven mechanism is slid to the second position, the clamping mechanism moves inwards to clamp the object, and the driven mechanism clamps the support mechanism to prevent the driven mechanism from moving relative to the support mechanism so the clamping mechanism can hold the object firmly. When the driven mechanism is slid to the first position, the clamping mechanism expands out to allow the object to be released.

13 Claims, 6 Drawing Sheets

HOLDING APPARATUS

BACKGROUND

1. Technical Field

The present disclosure relates to holding apparatuses for clamping objects.

2. Description of Related Art

During a process which applies heat to an object (for example, a soldering operation), the object is generally positioned on a table. However, heat from the operation may be absorbed by the object, and an operator may suffer burns when touching the object after the operation.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
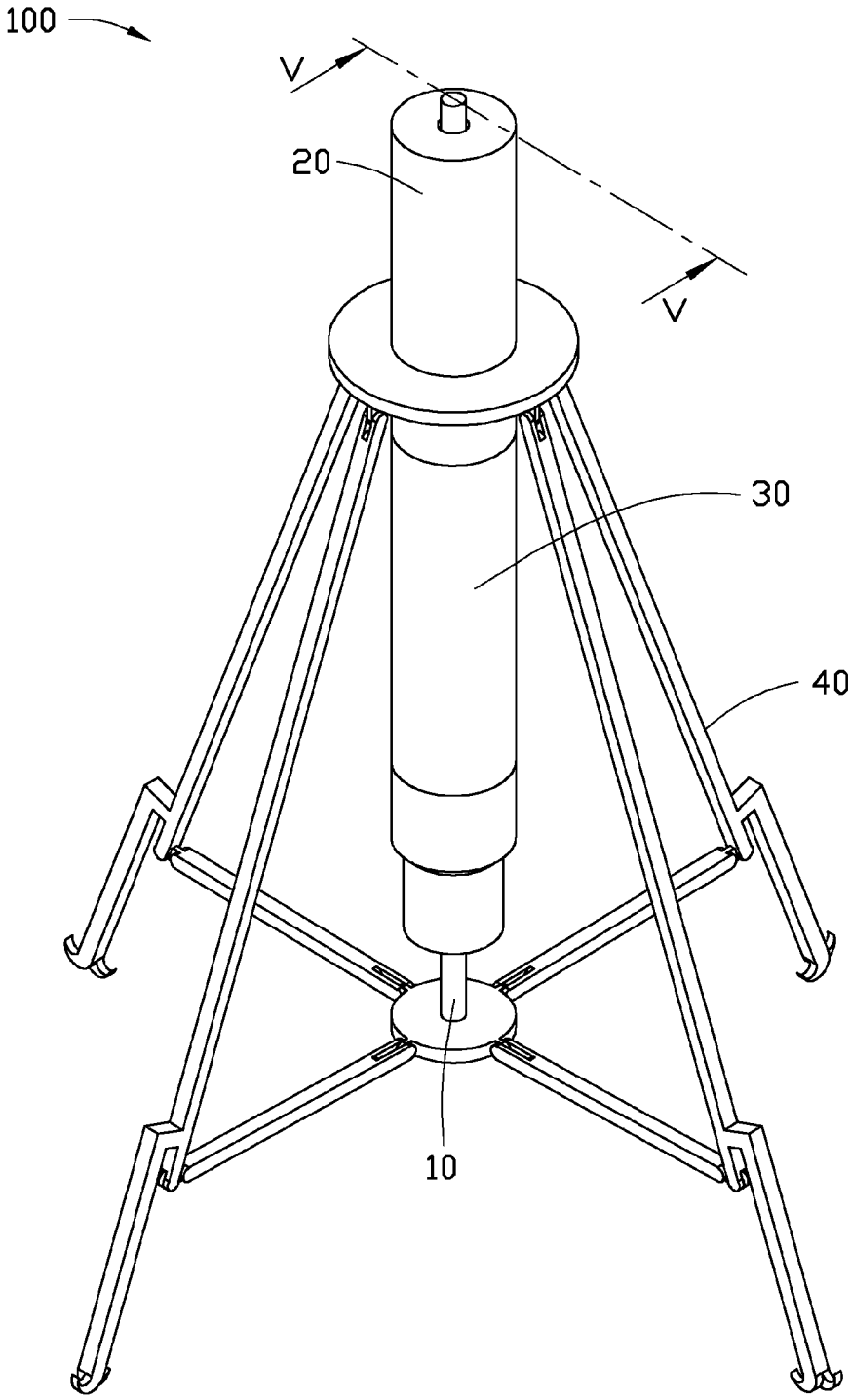
FIG. 1 is a perspective view of a holding apparatus in accordance with an embodiment.

FIG. 1, illustrates a holding apparatus 100 of one embodiment of the disclosure. The holding apparatus 100 is adapted to hold thin flat objects, such as a printed circuit board (PCB). The holding apparatus 100 includes a support mechanism 10, a driven mechanism 20, a driving mechanism 30 and a clamping mechanism 40 for clamping the PCB. The driven mechanism 20 and the driving mechanism 30 are slidably coupled to the support mechanism 10. The clamping mechanism 40 is pivotally coupled to the driving mechanism 30 and the support mechanism 10. The driving mechanism 30 drives the driven mechanism 20 between a first position and a second position, relative to the support mechanism 10. When the driven mechanism 20 has been slid to the first position or the second position, the driven mechanism 20 grips the support mechanism 10 to prevent any further movement by the driven mechanism 20 relative to the support mechanism 10. The clamping mechanism 40 moves inwards to clamp the PCB when the driven mechanism 20 moves from the first position to the second position, and expands outwards to release the PCB when the driven mechanism 20 moves from the second position to the first position.

Figure 2:
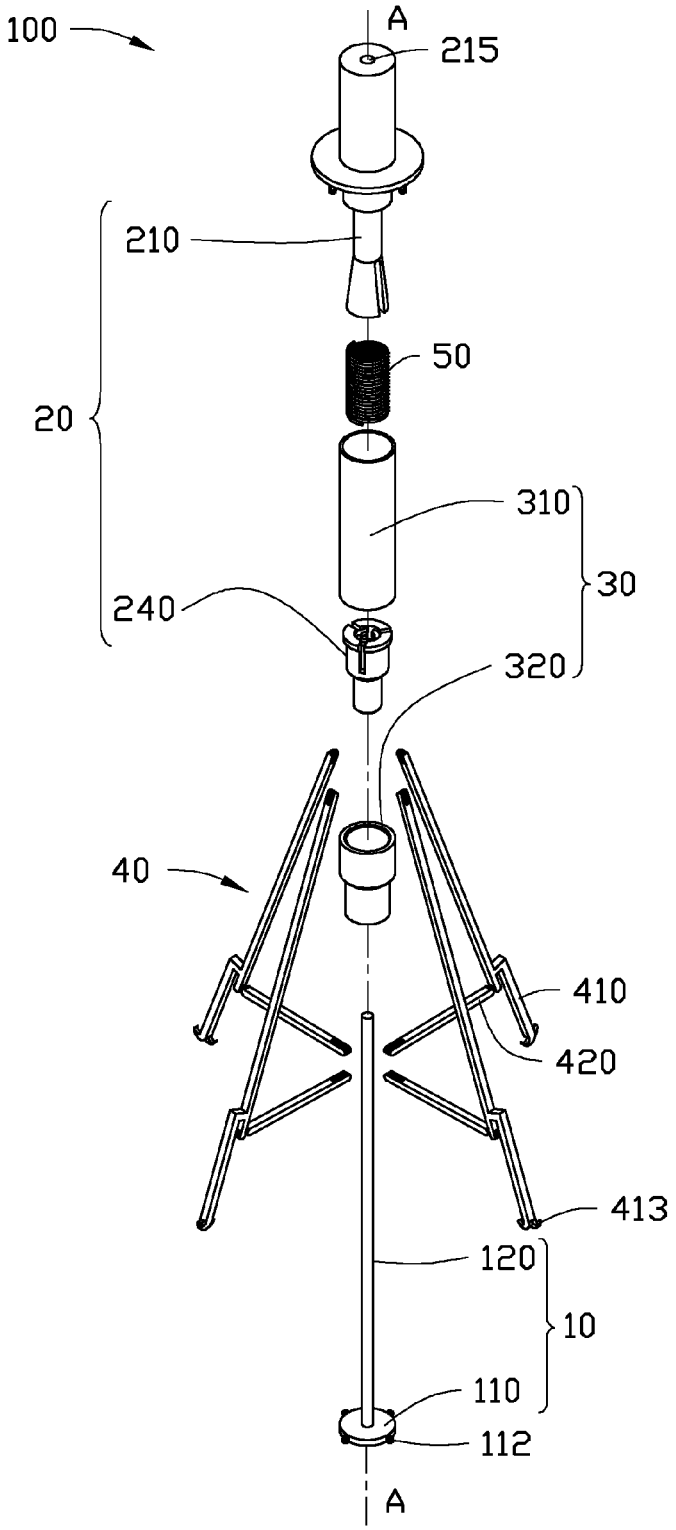
FIG. 2 is a disassembled perspective view of the holding apparatus of FIG. 1.

Referring to FIG. 2, the support mechanism 10 includes a support plate 110 and a support post 120. The support plate 110 is substantially circular. Four bearings 112 are evenly arranged on a circular rim of the support plate 110. The support post 120 is perpendicularly secured to the center of the support plate 110 and is aligned with an axis A of the support plate 110.

Figure 3:
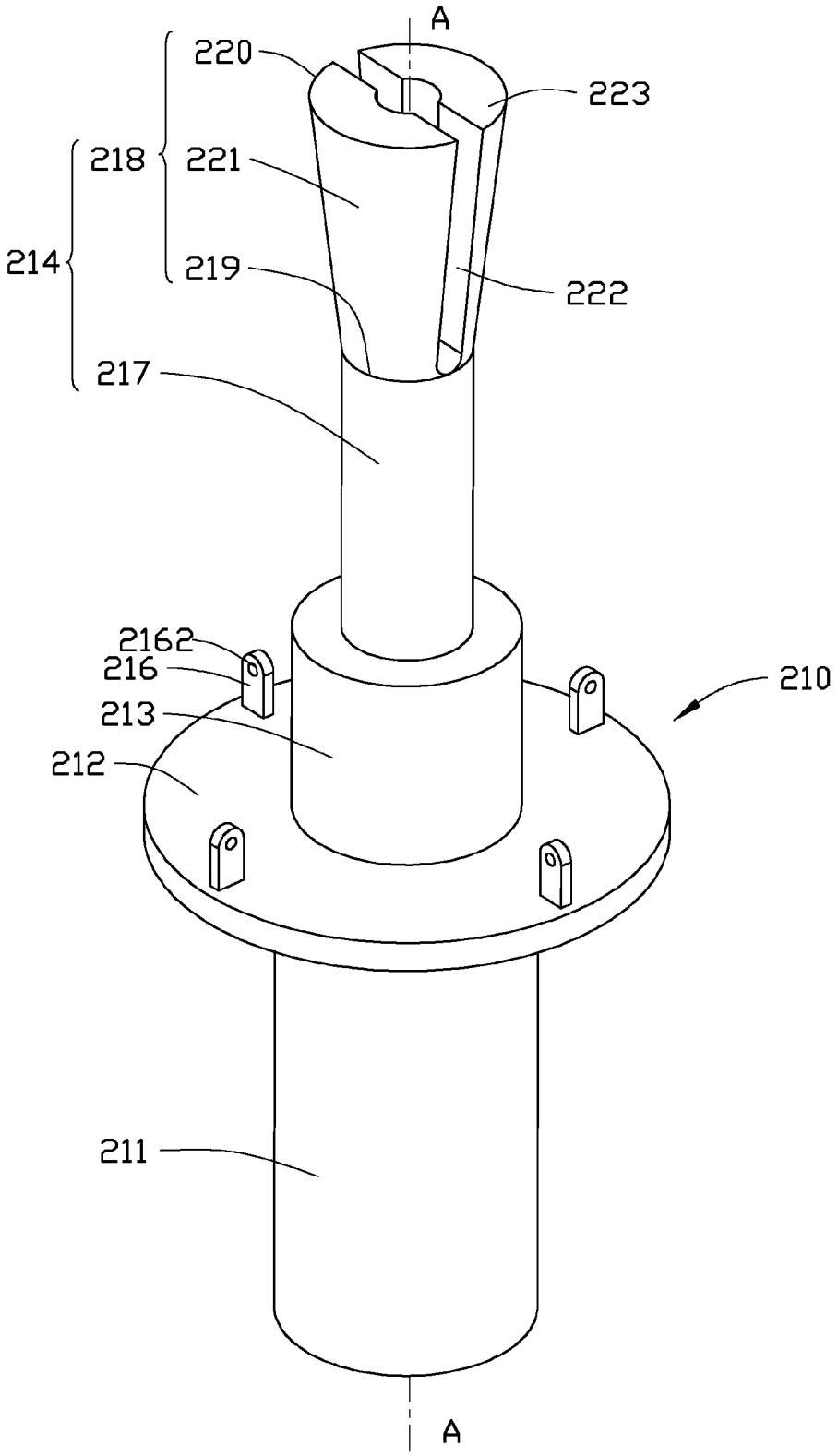
FIG. 3 is a perspective view of an enlarged first elastic clamp in the holding apparatus shown in FIG. 2.

The driven mechanism 20 is slidably coupled to the support post 120. The driven mechanism 20 includes a first elastic clamp 210 and a second elastic clamp 240. Referring to FIG. 3, the first elastic clamp 210 includes a substantially cylindrical base 211, a substantially circular connecting plate 212 secured to an end of the base 211, a substantially cylindrical connecting post 213 secured to an end of the connecting plate 212 opposite to the base 211, and a first abutting portion 214 secured to an end of the connecting post 213 away from the connecting plate 212. The base 211, the connecting plate 212, the connecting post 213 and the first abutting portion 214 are coaxial with the axis A, and each of them defines a first through hole 215 (see FIG. 5) extending along the axis A and communicating with each other. The diameter of the connecting post 213 is less than the diameter of the connecting plate 212. Four connecting members 216 are secured to an end of the connecting plate 212 opposite to the base 211. The connecting members 216 are evenly spaced around the connecting post 213. Each connecting member 216 defines a shaft hole 2162.

The first abutting portion 214 includes a column 217 secured to an end of the connecting post 213 away from the connecting plate 212 and a first clamp portion 218 projecting from an end of the column 217 away from the connecting post 213. The first clamp portion 218 is substantially a truncated cone. The first clamp portion 218 includes a first end 219 adjacent to the column 217, a second end 220 opposite to the first end 219, and an inclined surface 221 connecting the first and second ends 219 and 220. The diameter of the first end 219 is substantially equal to the diameter of the column 217, the diameter of the second end 220 is greater than the diameter of the column 217. The first clamp portion 218 defines a slit 222 extending along the axis A. The slit 222 extends from the second end 220 to the first end 219 and divides the first clamp portion 218 into two spaced elastic arms 223. When the inclined surface 221 is depressed, the slit 222 provides space for the elastic arms 223 to move towards each other, whereby the overall diameter of the second end 220 is lessened.

Figure 4:
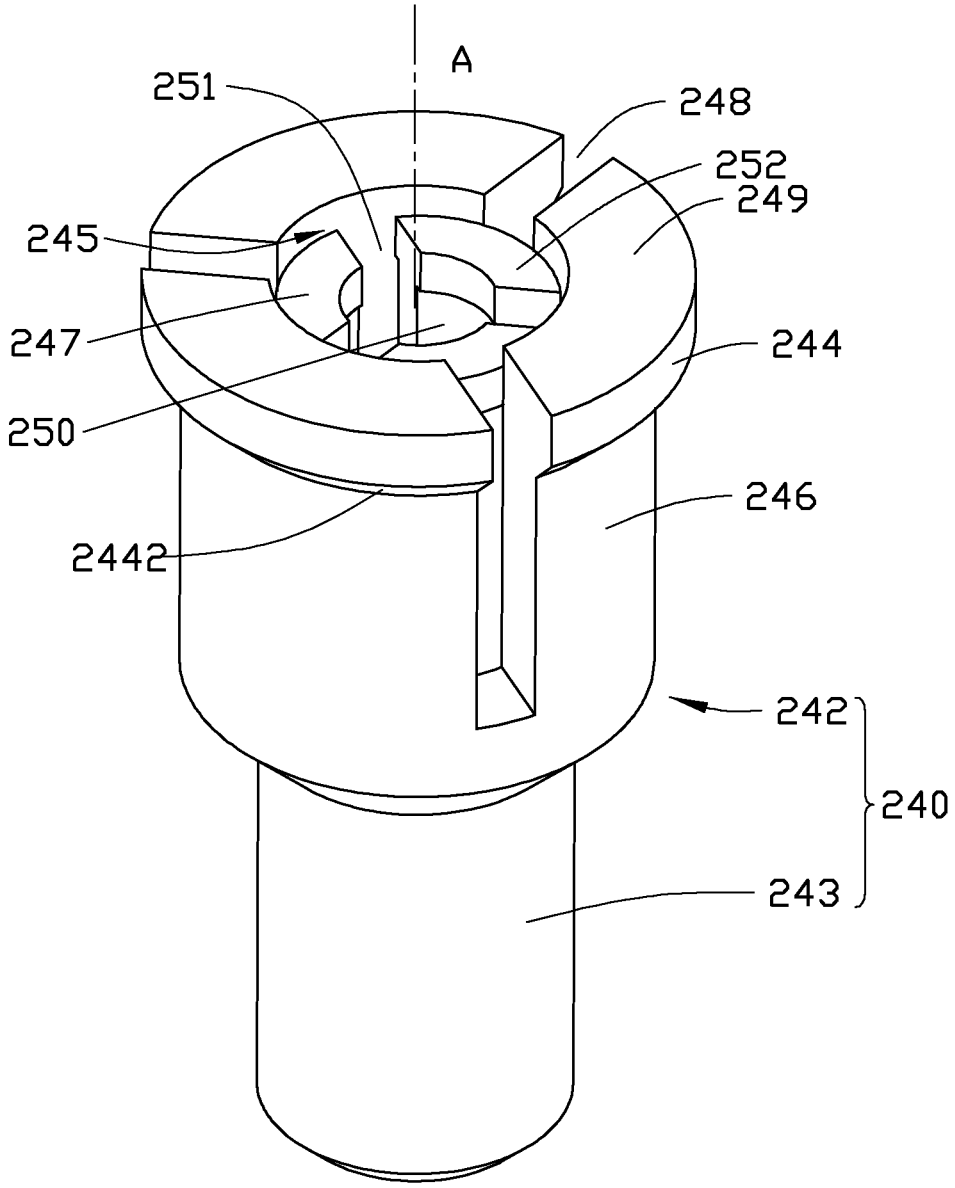
FIG. 4 is a perspective view of an enlarged second elastic clamp in the holding apparatus shown in FIG. 2.

Referring to FIG. 4, the second elastic clamp 240 is slidably coupled to the support post 120. The second elastic clamp 240 includes a substantially cylindrical second abutting portion 242, and a sliding post 243 secured to an end of the second abutting portion 242. The second abutting portion 242 and the sliding post 243 are coaxial with the axis A.

The end of the second abutting portion 242 away from the sliding post 243 is flanged (flange 244). A slant surface 2442 connects the flange 244 with the outer surface of the second abutting portion 242. An end of the second abutting portion 242 away from the sliding post 243 defines an annular groove 245. The annular groove 245 extends parallel to and is coaxial with the axis A. The annular groove 245 divides the second abutting portion 242 into an outer sleeve 246 and an inner sleeve 247, the inner sleeve 247 being received in the outer sleeve 246. The outer sleeve 246 defines three first slots 248 communicating with the annular groove 245. The three first slots 248 are evenly arranged around and extend parallel to the axis A. The periphery of the outer sleeve 246 is divided into three equal segments (first elastic cantilevers 249) by the three first slots 248. When the flange 244 is depressed, the annular groove 245 cooperates with the first slots 248 to allow the first elastic cantilevers 249 to move inward toward the axis A.

The structure of the inner sleeve 247 is similar to that of the outer sleeve 246. The inner sleeve 247 defines a second through hole 250 and three second slots 251 communicating between the second through hole 250 and the annular groove 245. The second slots 251 are staggered, or out of phase, with the first slots 248. The inner sleeve 247 is divided into three second elastic cantilevers 252 by the second slots 251. The second elastic cantilevers 252 are also staggered from the first elastic cantilevers 249. The second through hole 250 extends along the axis A and extends through the sliding post 243.

Figure 5:
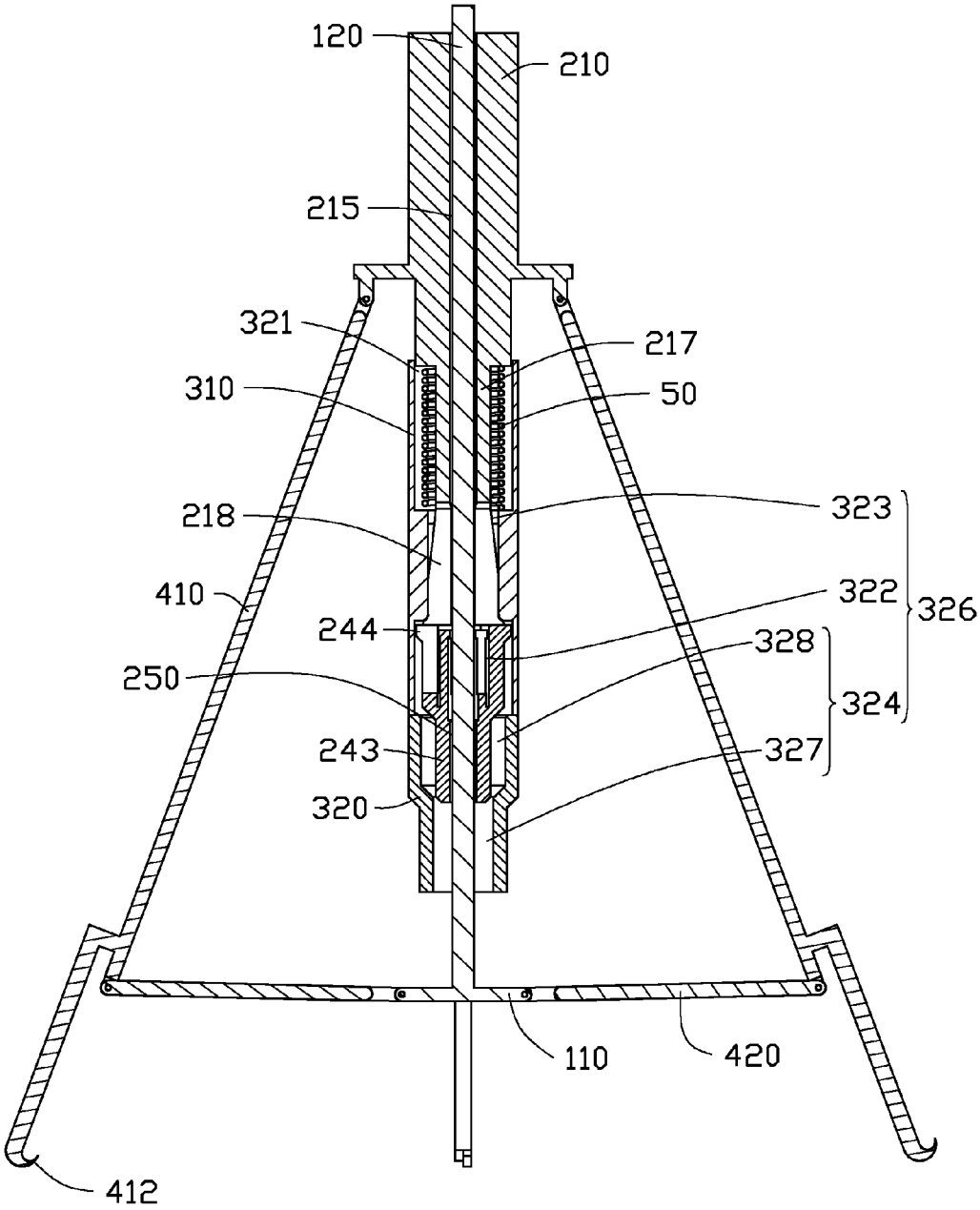
FIG. 5 is a cross-sectional view taken along line V-V of FIG. 1.

Referring again to FIG. 2, the driving mechanism 30 includes a hollow first cylinder 310 and a hollow second cylinder 320 secured to the first cylinder 310. Referring to FIG. 5, an end of the first cylinder 310 away from the second cylinder 320 defines a receiving groove 321. The diameter of the receiving groove 321 is slightly greater than the diameter of the connecting post 213. An end of the first cylinder 310 adjacent to the second cylinder 320 further defines a limiting groove 322. The middle of the first cylinder 310 further defines a first received portion 323 for communicating between the limiting groove 322 and the receiving groove 321. The diameter of the first receiving portion 323 is greater than the diameter of the first end 219, but is less than the diameter of the second end 220, the diameter of the limiting groove 322, and the diameter of the receiving groove 321. The diameter of the limiting groove 322 is slightly greater than the diameter of the second end 220 and the diameter of the flange 244.

The second cylinder 320 defines a second receiving portion 324 for receiving the second elastic clamp 240. The second receiving portion 324 cooperates with the limiting groove 322 and the first receiving portion 323 to form a receiving space 326. The cross section of the second receiving portion 324 in a direction parallel to the axis A is similar to that of the second elastic clamp 240. The second receiving portion 324 includes a first portion 327 and a second portion 328 communicating with the first portion 327 and the limiting groove 322. The diameter of the second portion 328 is less than the diameter of the flange 244, but is greater than the diameter of the first portion 327. The diameter of the first portion 327 is greater than the diameter of the sliding post 243.

The clamp mechanism 40 includes four clamp arms 410 and four connecting rods 420. The clamp arms 410 are rotatably coupled to the connecting members 216. A hooking portion 412 is secured to an end of each clamp arm 410 away from the connecting members 216. The hooking portion 412 includes two hooks 413 extending away from each other. In the embodiment, one of the hooks 413 bends toward the support plate 110, the other hook 413 bends back from the support plate 110. Opposite ends of each connecting rod 420 are rotatably coupled to one of the bearings 112 and to an end of one of the clamp arms 410 away from the connecting member 216.

The holding apparatus 100 further includes an elastic member 50. Opposite ends of the elastic member 50 abut the driving mechanism 30 and the driven mechanism 20 respectively. When the driven mechanism 20 slides to the first position, the elastic member 50 provides an elastic force for retaining the clamp mechanism 40 to firmly hold the PCB. The elastic member 50 is a coil spring in the embodiment, the diameter of the elastic member 50 is greater than the diameter of the column 217 and the diameter of the first receiving portion 323, but is less than the diameter of the connecting post 213 and the diameter of the limiting groove 322.

Referring to FIG. 5, in assembly, first, the elastic member 50 sleeves on the column 217 and abuts an end of the connecting post 213 away from the connecting plate 212. Second, the first abutting portion 218 of the first elastic clamp 210 extends through the first receiving portion 323 with the second end 220 being received in the limiting groove 322. Third, the second elastic clamp 240 is received in the second received portion 324. The second cylinder 320 is secured to the first cylinder 310, such that the second receiving portion 324, the limiting groove 322 and the first receiving portion 323 communicate with each other to form the receiving space 326. Then, the support post 120 extends through the receiving space 326, the second through hole 250, the first through hole 215, and the receiving groove 321 in that order. Finally, the clamp arms 410 are rotatably coupled to the connecting members 216, and are further rotatably coupled to the bearings 112.

After assembly, referring to FIG. 5, the holding apparatus 100 is in a ready state, the elastic member 50 is uncompressed, and the driven mechanism 20 is in the first position with the first elastic clamp 210 being partially received in the first receiving portion 323 and the second elastic clamp 240 being received in the limiting groove 322. In this state, because the diameter of the second end 220 of the first clamp portion 218 is greater than the diameter of the first receiving portion 323, the first clamp portion 218 is partially received in the first receiving portion 323, and the elastic arms 223 moves inward to grip the support post 120 to prevent the first elastic clamp 210 from sliding relative to support post 120.

Figure 6:
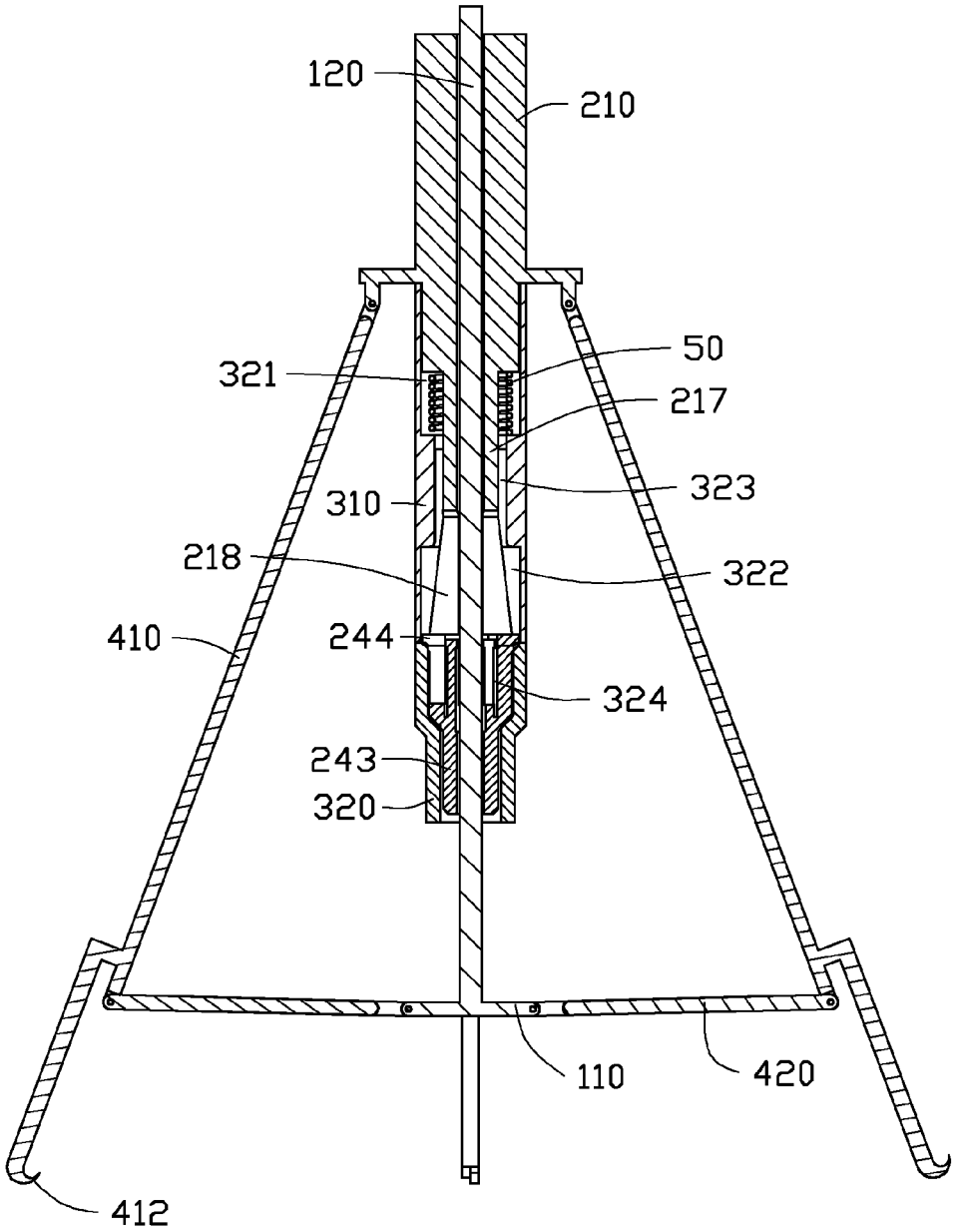
FIG. 6 is a cross-sectional view showing the holding apparatus of FIG. 1 clamping an object.

Referring to FIG. 6, to clamp the PCB: the driving mechanism 30 slides away from the support plate 110. Because the first elastic clamp 210 is prevented from sliding relative to the support post 120, when the driving mechanism 30 slides away from the support plate 110, the first clamp portion 218 remains still relative to the support post 120 and slides out of the first receiving portion 323 to allow the first clamp 210 to slide relative to the support post 120. When the driving portion 30 abuts the connecting plate 212, the elastic member 50 is compressed, and the clamp arms 410 move inward toward the support post 120 to hold the PCB. At the same time, the first abutting portion 214 slides out of the first receiving portion 323 and the first clamp 210 pushes the second elastic clamp 240 to be received in the second receiving portion 324. Because the diameter of the flange 244 is greater than the diameter of the second portion 328 of the second receiving portion 324, when the second elastic clamp 240 is received in the second receiving portion 324, the first and second elastic cantilevers 249 and 252 of the second abutting portions 242 move inward toward to grip the support post 120 to prevent the second elastic clamp 240 from sliding relative to the support post 120, thus, the holding apparatus 100 maintains a firm hold on the PCB.

Referring again to FIG. 5, to release the PCB, the driving mechanism 30 slides adjacent to the support plate 110. Because the second elastic clamp 240 is prevented from sliding relative to the support post 120, when the driving mechanism 30 slides adjacent to the support plate 110, the second elastic clamp 240 remains still and slides out of the second receiving portion 324 to allow the second elastic clamp 240 to slide relative to the support post 120. At this time, the elastic member 50 can restore to its original position and provides an elastic force to drive the driven mechanism 20 to slide to the second position with the first clamp portion 218 being received in the first receiving portion 323 again, and the clamp arms 40 are rotated to release the PCB.

It is to be understood, even though information as to, and advantages of, the present embodiments have been set forth in the foregoing description, together with details of the structures and functions of the present embodiments, the disclosure is illustrative only; and that changes may be made in detail, especially in the matters of shape, size, and arrangement of parts within the principles of the present embodiments to the full extent indicated by the broad general meaning of the terms in which the appended claims are expressed.

What is claimed is:

1. A holding apparatus for holding an object, the holding apparatus comprising:

a support mechanism;

a driven mechanism slidably coupled to the support mechanism and capable of sliding between a first position and a second position different from the first position;

a driving mechanism slidably coupled to the support mechanism and adapted to drive the driven mechanism to slide between the first position and the second position, the driving mechanism comprising a first elastic clamp and a second elastic clamp; and a clamping mechanism rotatably secured to the driven mechanism and the support mechanism, the clamping mechanism comprising a plurality of hooks for clamping the object;

wherein the first elastic clamp clamps the support mechanism to prevent the driven mechanism from moving relative to the support mechanism when the driven mechanism slides to the first position, the second elastic clamp clamps the support mechanism to prevent the driven mechanism from moving relative to the support mechanism to retain the clamping mechanism to hold the object when the driven mechanism slides to the second position, the driving mechanism defining a receiving space for receiving the first and second elastic clamps, the receiving space comprising a first receiving portion for receiving the first elastic clamp, a second receiving portion for receiving the second elastic clamp, and a limiting groove for communicating the first receiving portion with the second receiving portion, when the driven mechanism slides from the first position to the second position, the hooks of the clamping mechanism move inward toward to clamp the object, and the driven mechanism grips the support mechanism to prevent the driven mechanism from moving relative to the support mechanism to maintain the hooks of the clamping mechanism to firmly hold the object; when the driven mechanism slides from the second position to the first position, the clamping mechanism expands outwards to allow the object to be released.

2. The holding apparatus of claim 1, further comprising an elastic member, wherein the elastic member is arranged between the driving mechanism and the driven mechanism, when the driven mechanism slides to the second position, the elastic member provides an elastic force to maintain the clamping mechanism to hold the object firmly.

3. The holding apparatus of claim 1, wherein the first receiving portion drives the first elastic clamp to grip the support mechanism to prevent the driven mechanism from moving when the driven mechanism slides to the first position, the second receiving portion drives the second elastic clamp to grip the support mechanism to prevent the driven mechanism from moving when the driven mechanism slides to the second position.

4. The holding apparatus of claim 1, wherein the first elastic clamp comprises a column defining a first through hole and a first abutting portion secured to an end of the column, an end of the first abutting portion away from the column is greater than the diameter of the first receiving portion.

5. The holding apparatus of claim 4, wherein the first abutting portion defines a slit communicating with the first through hole, the slit divides the first abutting portion into two spaced elastic arms, the slit provides space for the elastic arms moving toward each other to lessen the overall diameter of the first abutting portion.

6. The holding apparatus of claim 1, wherein the second elastic clamp comprises a sliding post and a second abutting portion secured to an end of the sliding post, a flange protrudes from an end of the second abutting portion away from the sliding post, the diameter of the flange is greater than the diameter of the second receiving portion.

7. The holding apparatus of claim 6, wherein the second abutting portion defines an annular groove for dividing the second abutting portion into an outer sleeve and an inner sleeve received in the outer sleeve.

8. The holding apparatus of claim 7, wherein the outer sleeve defines a plurality of first slots, the first slots divide the outer sleeve into a plurality of first elastic cantilevers, the first slots cooperate with the annular groove to provide space for the first elastic cantilevers moving toward each other when the second abutting portion is depressed.

9. The holding apparatus of claim 8, wherein the inner sleeve defines a second through hole and a plurality of second slots communicating with the second through hole, the second slots divides the inner sleeve into a plurality of second elastic cantilevers, the second slots allow the second elastic cantilevers to move inward when the second elastic cantilevers are depressed by the first elastic cantilevers.

10. The holding apparatus of claim 9, wherein the second elastic cantilevers are staggered with the first elastic cantilevers.

11. The holding apparatus of claim 1, wherein the clamping mechanism comprises at least two clamp arms and at least two connecting rods, the at least two clamp arms are rotatably coupled to the driven mechanism, opposite ends of each connecting rod are rotatably secured to one of the clamp arms and the support mechanism.

12. The holding apparatus of claim 11, wherein each hook is secured to an end of each clamp arm away from the driven mechanism.

13. A holding apparatus for holding an object, the holding apparatus comprising:

a support mechanism;

a driven mechanism slidably coupled to the support mechanism and capable of sliding between a first position and a second position different from the first position;

a clamping mechanism rotatably secured to the driven mechanism and the support mechanism, the clamping mechanism comprising a plurality of hooks for clamping the object; and a driving mechanism slidably coupled to the support mechanism and adapted to drive the driven mechanism between the first position and the second position, the driving mechanism comprising:

a first elastic clamp configured to clamp the support mechanism to prevent the driven mechanism from moving relative to the support mechanism when the driven mechanism is in the first position; and a second elastic clamp configured to clamp the support mechanism to prevent the driven mechanism from moving relative to the support mechanism to retain the clamping mechanism to hold the object when the driven mechanism is in the second position, the driving mechanism defining a first receiving portion for receiving the first elastic clamp, a second receiving portion for receiving the second elastic clamp, and a limiting groove for connecting the first receiving portion with the second receiving portion, wherein when the driven mechanism slides from the first position to the second position, the plurality of hooks of the clamping mechanism clamp the object and the driven mechanism grips the support mechanism to prevent the driven mechanism from moving relative to the support mechanism, and wherein when the driven mechanism slides from the second position to the first position, the clamping mechanism expands outwardly to allow the object to be released.

* * * * *